US008887629B2

(12) United States Patent
Nilsson et al.

(10) Patent No.: US 8,887,629 B2
(45) Date of Patent: Nov. 18, 2014

(54) RETAINER UNIT AND WIRE BINDING MACHINE COMPRISING SEVERAL SUCH RETAINER UNITS

(75) Inventors: Lennart Nilsson, Sundsvall (SE); Thomas Biberg, Kovland (SE)

(73) Assignee: Sund Birsta AB, Sundsvall (SE)

( * ) Notice: Subject to any disclaimer, the term of this patent is extended or adjusted under 35 U.S.C. 154(b) by 0 days.

(21) Appl. No.: 14/126,146

(22) PCT Filed: May 29, 2012

(86) PCT No.: PCT/EP2012/059981

§ 371 (c)(1),
(2), (4) Date: Dec. 13, 2013

(87) PCT Pub. No.: WO2012/171779

PCT Pub. Date: Dec. 20, 2012

(65) Prior Publication Data

US 2014/0137754 A1 May 22, 2014

(30) Foreign Application Priority Data

Jun. 14, 2011 (EP) ..... 11169754

(51) Int. Cl.
*B65B 13/22* (2006.01)
*B65B 13/06* (2006.01)
*B65B 13/18* (2006.01)

(52) U.S. Cl.
CPC ..... *B65B 13/22* (2013.01); *B65B 13/18* (2013.01); *B65B 13/06* (2013.01)
USPC ..... 100/26; 100/32

(58) Field of Classification Search
USPC ..... 100/8, 16, 25, 26, 29, 31, 32; 53/589; 140/57, 93.6, 119; 226/143, 177
See application file for complete search history.

(56) References Cited

U.S. PATENT DOCUMENTS

| | | | | |
|---|---|---|---|---|
| 3,052,394 | A | 9/1962 | Linehan et al. | |
| 3,387,556 | A | 6/1968 | Cranston, Jr. et al. | |
| 3,999,476 | A | 12/1976 | Thompson | |
| 4,252,157 | A * | 2/1981 | Ohnishi | 140/93 A |
| 5,027,701 | A * | 7/1991 | Izui et al. | 100/26 |
| 5,746,120 | A | 5/1998 | Jonsson | |
| 6,968,779 | B2 * | 11/2005 | Doyle et al. | 100/2 |

FOREIGN PATENT DOCUMENTS

GB 2267075 A 11/1993

* cited by examiner

*Primary Examiner* — Jimmy T Nguyen
(74) *Attorney, Agent, or Firm* — Dilworth & Barrese, LLP.

(57) ABSTRACT

A retainer unit for use in a wire binding machine in order to retain and subsequently release a wire during the tightening thereof around one or more objects. The retainer unit comprises: a wire retaining member pivotable, under the action of a press force exerted by a wire, from an advanced wire retaining position to a retracted wire releasing position; a blocking mechanism moveable from a blocking position, in which it prevents the wire retaining member from being pivoted to the wire releasing position, to a non-blocking position, in which it allows the wire retaining member to be pivoted to the wire releasing position. The blocking mechanism is arranged to move to the non-blocking position under the effect of said wire when the wire reaches a given inclination towards a wire contacting part of the wire retaining member. The invention also relates to a wire binding machine comprising several such retainer units.

20 Claims, 10 Drawing Sheets

A-A

RETAINER UNIT AND WIRE BINDING MACHINE COMPRISING SEVERAL SUCH RETAINER UNITS

FIELD OF THE INVENTION AND PRIOR ART

The present invention relates to a retainer unit for use in a wire guide track arrangement of a wire binding machine. The invention also relates to a wire binding machine comprising several such retainer units.

Automatic wire binding machines for applying a wire in a loop around an object or a bundle of objects, drawing the wire tightly around the object/bundle and thereafter tying overlapping wire portions together in order to secure the wire around the object/bundle are known in many different configurations. Different types of such wire binding machines are for instance disclosed in U.S. Pat. No. 3,052,394 A, U.S. Pat. No. 3,387,556 A and U.S. Pat. No. 5,746,120 A.

When using a wire binding machine for applying loops of metal wire around objects sensitive to wearing, such as for instance a bundle of rods, pipes or other objects of metallic material, the objects may be subjected to surface damages by wearing if the metal wire slides against the objects during the tightening of the wire around the objects. Such wire sliding and surface damages can be avoided or at least reduced by means of retainer units, which are distributed along the wire guide track of the wire binding machine and which are configured to temporarily retain the wire and thereby keep it at a distance from the objects when the wire is pulled backwards and forced out of the guide track in order to be tightened around the objects. The retainer units are made to release the wire consecutively one by one during the tightening of the wire around the objects to thereby allow the wire to gradually come into contact with the objects, starting with the retainer unit located closest to the leading end of the wire as seen in the direction backwards along the wire from the leading end thereof. The retainer units prevent the wire from sliding along the objects during the tightening of the wire around the objects and they also make it possible to draw the wire more tightly around the objects. When using a hydraulic motor for pulling the wire, the motor may be operated to pull the wire with the retainer units in the wire retaining position until the motor is unable to pull the wire any tighter and thereby stalls, whereupon a first retainer unit is opened to release the wire under the effect of a control signal from an electronic control unit. Thereafter the motor is accelerated to pull the wire with the other retainer units in the wire retaining position until the motor is unable to pull the wire any tighter and thereby stalls, whereupon the next retainer unit is opened, and so on until all the retainer units have been made to release the wire and the wire has been brought into close contact with the objects all around the objects. An electric motor has certain advantages over a hydraulic motor and the use of an electric motor for feeding and retracting the wire in a wire binding machine could therefore be desired. However, an electric motor will cause powerful jerks in the wire due to the moment of inertia of the rapidly rotating rotor if the electric motor is operated in the above-mentioned manner with repeated stalls and accelerations. The wire might be broken by these jerks. Thus, there is a need for an alternative solution to the above-mentioned problem, which is also appropriate for use in a wire binding machine where an electric motor is used for tightening the wire around the objects to be bound.

SUMMARY OF THE INVENTION

The object of the present invention is to provide a retainer unit of new and favorable design, which makes it possible to reduce the sliding of the wire against the objects to be bound during the tightening of the wire around the objects and which is suitable for use in a wire binding machine having an electric motor for retracting the wire.

According to the present invention, said object is achieved by a retainer having the features defined herein; and The retainer unit according to the invention comprises:

- a base to be fixedly mounted to a structural part of a wire guide track arrangement of a wire binding machine;
- a wire retaining member, which is pivotally mounted to the base and comprises a wire contacting part intended to come into contact with a wire during the tightening thereof around one or more objects, the wire retaining member being pivotable, under the action of a press force exerted by a wire bearing against the wire contacting part, from an advanced wire retaining position, in which the wire retaining member keeps the wire retained to the retainer unit, to a retracted wire releasing position, in which the wire is released from the retainer unit;
- a blocking mechanism, which is moveable from a blocking position, in which the blocking mechanism prevents the wire retaining member from being pivoted from the wire retaining position to the wire releasing position, to a non-blocking position, in which the blocking mechanism allows the wire retaining member to be pivoted from the wire retaining position to the wire releasing position.

The blocking mechanism is arranged to move from the blocking position to the non-blocking position under the effect of said wire when the wire, during the tightening thereof around one or more objects and on reaching a given inclination towards the wire contacting part of the wire retaining member, comes into contact with a maneuvering member included in the blocking mechanism and moves this maneuvering member from an advanced position to a retracted position. Thus, the wire is only capable of pivoting the wire retaining member to the wire releasing position after having reached a given inclination towards the wire contacting part of the wire retaining member. Before the wire has reached this inclination, the blocking mechanism is kept in the blocking position and thereby prevents the wire retaining member from being pivoted from the wire retaining position to the wire releasing position. By a suitable positioning of several retainer units of this type along the wire guide track of a wire binding machine, the retainer units can be made to automatically release the wire consecutively one by one during the tightening of the wire around one or more objects and thereby reduce the sliding of the wire against said objects, as will be more closely described below in the detailed part of the description with reference to FIGS. 4*a*-4*g*. The retainer units according to the present invention can be achieved to automatically release the wire consecutively one by one during a continuous pulling of the wire, without requiring any repeated stalls and accelerations of the motor during the pulling operation. Thus, the tightening of the wire can be made in a more rapid manner as compared to the case described above with repeated stalls and accelerations of the motor during the tightening process, and an electric motor will consequently be suitable for use in a wire binding machine equipped with this new type of retainer units. Furthermore, no electronic control unit is required for controlling the opening of the retainer units.

Further advantages as well as advantageous features of the retainer unit according to the present invention will appear from the following description.

The invention also relates to a wire binding machine which is provided with several retainer units according the present invention.

BRIEF DESCRIPTION OF THE DRAWINGS

With reference to the appended drawings, a specific description of preferred embodiments of the invention cited as examples follows below. In the drawings.

DETAILED DESCRIPTION OF PREFERRED EMBODIMENTS OF THE INVENTION

Figure 1C:
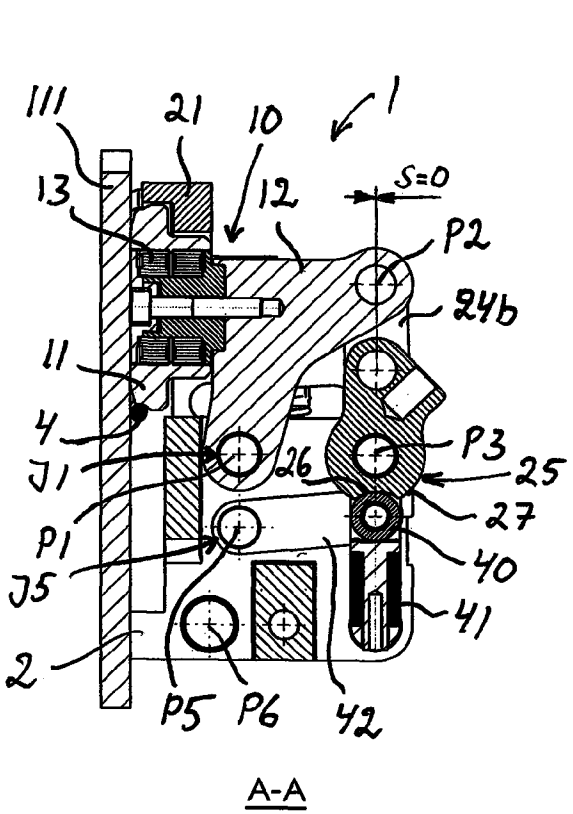
FIG. 1*c* is a sectional view according to the line A-A in FIG. 1*b*.

FIGS. 1-3 show a retainer unit 1 according to an embodiment of the present invention for use in a wire guide track arrangement of a wire binding machine in order to retain and subsequently release a wire during the tightening of the wire around one or more objects.

The retainer unit 1 comprises a base 2, which is to be fixedly mounted to a structural part 111 of a wire guide track arrangement of a wire binding machine, and a wire retaining member 10, which is pivotally mounted to the base 2. Said structural part 111 may be a plate or the similar. The wire retaining member 10 comprises a wire contacting part 11, which is intended to come into contact with a wire 4 during the tightening thereof around one or more objects. The wire retaining member 10 is pivotable, under the action of a press force exerted by a wire 4 bearing against the wire contacting part 11, from an advanced wire retaining position (see FIGS. 1*a*-1*c* and 2*a*-2*c*), in which the wire retaining member 10 keeps the wire 4 retained to the retainer unit 1, to a retracted wire releasing position (see FIGS. 3*a*-3*c*), in which the wire 4 is released from the retainer unit 1. The wire retaining member 10 is pivotable from said advanced wire retaining position to said retracted wire releasing position against the action of spring members 22*a*, 22*b*, 41 included in the retainer unit 1 and is automatically returned to the wire retaining position under the action of these spring members when the wire 4 has been released from the retainer unit. In the advanced wire retaining position, the wire contacting part 11 is kept so close to the structural part 111 that there is no room for the wire 4 to pass between the wire contacting part 11 and the structural part 111. When the wire retaining member 10 is pivoted to the retracted wire releasing position, the wire contacting part 11 is moved away from the structural part 111 while leaving room for the wire 4 to pass between the wire contacting part 11 and the structural part 111. In the illustrated example, the wire contacting part 11 bears against the structural part 111 when the wire retaining member is in the wire retaining position, as illustrated in FIGS. 1*a* and 1*b*.

In the illustrated embodiment, the wire retaining member 10 comprises a lever 12. This lever 12 carries the wire contacting part 11 and is pivotally mounted to the base 2 through a first joint J1, which forms a first pivot axis P1. The wire contacting part 11 has the form of a roller and is rotatably mounted in relation to the lever 12 by means of one or more bearings 13. When being tightened, the wire 4 is intended to come into contact with the envelop surface of the wire contacting part 11.

The retainer unit 1 comprises a blocking mechanism 20, which is moveable from a blocking position (see FIGS. 1*a*-1*c*), in which the blocking mechanism 20 prevents the wire retaining member 10 from being pivoted from the wire retaining position to the wire releasing position, to a non-blocking position (see FIGS. 2*a*-2*c*), in which the blocking mechanism 20 allows the wire retaining member 10 to be pivoted from the wire retaining position to the wire releasing position. The blocking mechanism 20 is arranged to move from the blocking position to the non-blocking position under the effect of a wire 4 bearing against the wire contacting part 11 of the wire retaining member when the wire, during the tightening thereof around one or more objects and on reaching a given inclination towards said wire contacting part 11, comes into contact with a maneuvering member 21 included in the blocking mechanism 20 and moves this maneuvering member 21 from an advanced position to a retracted position. The blocking mechanism 20 is moveable from the blocking position to the non-blocking position against the action of the spring force of one or more spring members 22*a*, 22*b*.

In the illustrated embodiment, the lever 12 of the wire retaining member is articulately connected to the blocking mechanism 20 through a second joint J2, which forms a second pivot axis P2 that extends in parallel with the above-mentioned first pivot axes P1.

In the illustrated embodiment, the blocking mechanism 20 comprises a blocking member 23 and a link 24. The blocking member 23 is pivotally mounted to the base 2 through a third joint J3, which forms a third pivot axis P3 that extends in parallel with the above-mentioned pivot axes P1, P2. The link 24 is at a first end articulately connected to the lever 12 of the wire retaining member through the above-mentioned second joint J2 and is at the other end articulately connected to the blocking member 23 through a fourth joint J4, which forms a fourth pivot axis P4 that extends in parallel with the above-mentioned pivot axes P1-P3. In the illustrated example, the link 24 comprises two mutually parallel shanks 24*a*, 24*b* arranged on either side of the lever 12 and the blocking member 23.

Figure 1B:
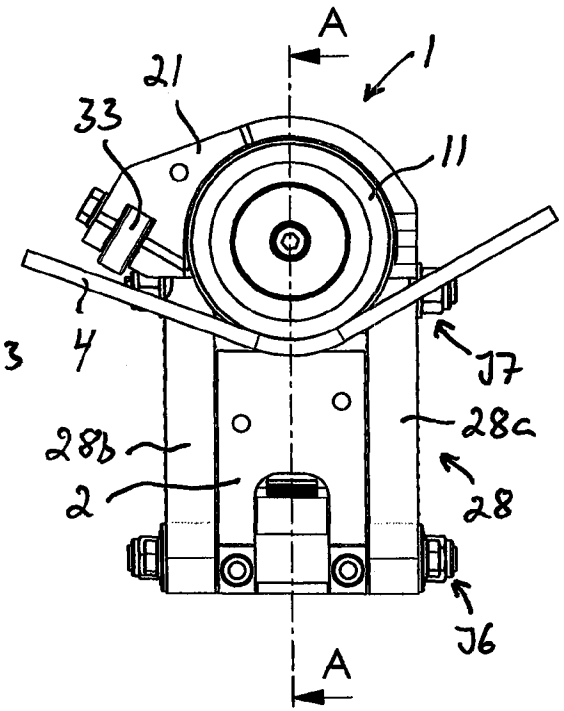
FIG. 1*b* is a front view corresponding to FIG. 1*a*.
Figure 1A:
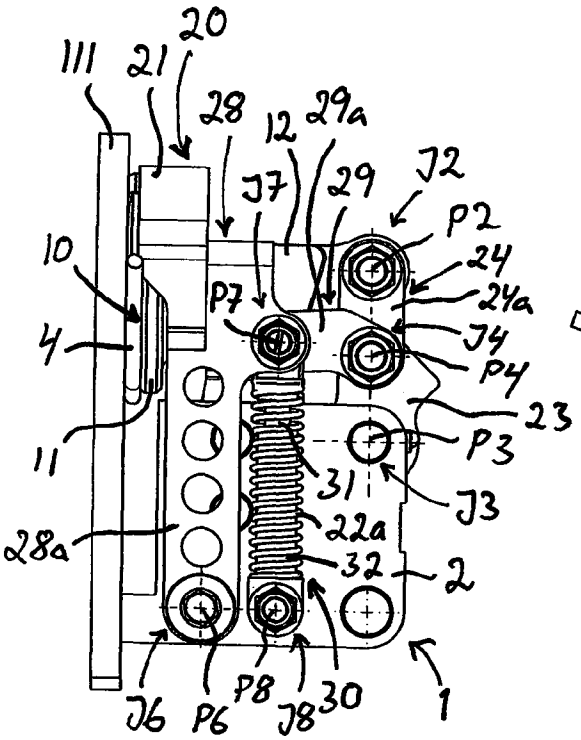
FIG. 1*a* is a lateral view of a retainer unit according to an embodiment of the present invention, as seen with the blocking mechanism in the blocking position and the wire retaining member in the wire retaining position.
Figure 2C:
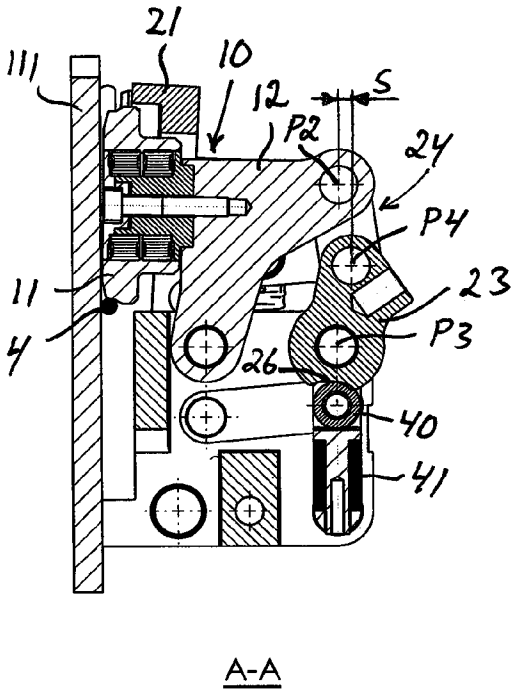
FIG. 2*c* is a sectional view according to the line A-A in FIG. 2*b*.

When the blocking mechanism 20 is in the blocking position, the blocking member 23 is located in such a rotational position about the third pivot axis P3 that the fourth pivot axis P4 lies in the plane in which the second and third pivot axes P2, P3 extend, as illustrated in FIGS. 1*a* and 1*c*. The lever 12 is thereby prevented from exerting any turning moment on the blocking member 23 via the link 24, and the lever 12 is thereby prevented from pivoting in relation to the base 2 about the first pivot axis P1. When the blocking member 23 is in this rotational position, the wire retaining member 10 is consequently prevented from pivoting from the wire retaining position to the wire releasing position. When the blocking mechanism 20 is in the non-blocking position, the blocking member 23 is located in such a rotational position about the third pivot axis P3 that the fourth pivot axis P4 is offset by a distance s from the plane in which the second and third pivot axes P2, P3 extend, as illustrated in FIGS. 2*a* and 2*c*. The lever 12 is thereby capable of exerting a turning moment on the blocking member 23 via the link 24 to thereby pivot the blocking member 23 in relation to the base 2 about the third pivot axis P3 while self pivoting in relation to the base 2 about the first pivot axis P1. When the blocking member 23 is in the last-mentioned rotational position, the wire retaining member 10 is consequently allowed to pivot from the wire retaining position to the wire releasing position. The blocking member 23 is connected to the maneuvering member 21 in such a manner that it is pivoted from the first-mentioned rotational position to the last-mentioned rotational position when the maneuvering member 21 is moved from its advanced position to its retracted position.

Figures 3A, 3B, 3C:
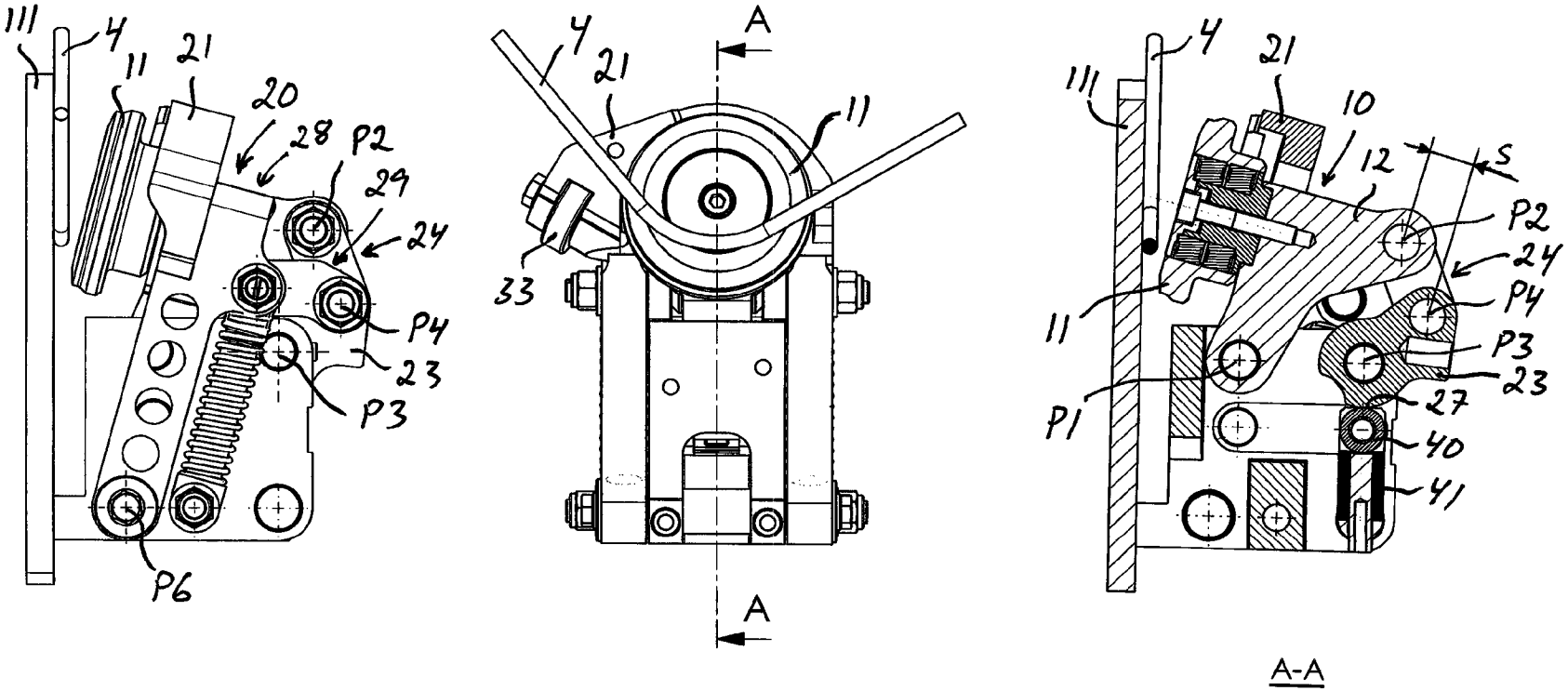
FIG. 3*a* is a lateral view of the retainer unit of FIG. 1*a*, as seen with the blocking mechanism in the non-blocking position and the wire retaining member in the wire releasing position.
FIG. 3*b* is a front view corresponding to FIG. 3*a*.
FIG. 3*c* is a sectional view according to the line A-A in FIG. 3*b*, FIGS. 4*a*-4*g* are lateral views of a part of a wire binding machine provided with retainer units of the type illustrated in FIGS. 1-3, as seen at different stages during the tightening of a wire around an object.

The retainer unit 1 comprises a rolling member 40, which is biased by means of a spring member 41 to bear against a guide surface 25 on the periphery of the blocking member 23 and which is arranged to roll along this guide surface 25 when the blocking member 23 is pivoted about the third pivot axis P3. The retainer unit 1 also comprises a swing arm 42 pivotally mounted to the base 2 through a fifth joint J5, which forms a fifth pivot axis P5 that extends in parallel with the above-mentioned pivot axes P1-P4. The rolling member 40 is rotatably mounted to this swing arm 42 at a distance from the fifth joint J5. The spring member 41 is with advantage formed of several individual Belleville springs piled on each other. A recess 26 is provided in the guide surface 25 on the blocking member. This recess 26 has a concave shape as seen in a plane perpendicular to the third pivot axis P3. The rolling member 40 is received in and arranged to roll within this recess 26 when the blocking member 23 is pivoted about the third pivot axis P3 during a movement of the blocking mechanism 20 from the blocking position to the non-blocking position, as illustrated in FIGS. 1*c* and 2*c*. The rolling member 40 is arranged to roll out of this recess 26 and up onto an adjacent part 27 of the guide surface 25 when the blocking member 23 is pivoted about the third pivot axis P3 during a movement of the wire retaining member 10 from the wire retaining position to the wire releasing position, as illustrated in FIG. 3*c*. The last-mentioned part 27 of the guide surface 26 has a circular cylindrical shape with a centre axis coinciding with the third pivot axis P3.

The spring member 41 also acts on the lever 12 of the wire retaining member 10 via the rolling member 40, the blocking member 23 and the link 24.

In the illustrated embodiment, the maneuvering member 21 is carried by a swing arm 28, which is pivotally mounted to the base 2 through a sixth joint J6, which forms a sixth pivot axis P6 that extends in parallel with the above-mentioned pivot axes P1-P5. This swing arm 28 is connected to the blocking member 23 and configured to effect a rotation of the blocking member about the third pivot axis P3 when the blocking mechanism 20 is moved from the blocking position to the non-blocking position. In the illustrated example, the swing arm 28 is connected to the blocking member 23 through a link 29. This link 29 is at one end articulately connected to the blocking member 23 through the fourth joint J4 and at the other end articulately connected to the swing arm 28 through a seventh joint J7, which forms a seventh pivot axis P7 that extends in parallel with the above-mentioned pivot axes P1-P6. In the illustrated example, the swing arm 28 comprises two mutually parallel shanks 28*a*, 28*b* arranged on either side of the lever 12, and the link 29 also comprises two mutually parallel shanks 29*a*, 29*b* arranged on either side of the lever 12 and the blocking member 23. A first spring member 22*a* is arranged to act on the first shank 28*a* of the swing arm 28 and a second spring member 22*b* is arranged to act on the second shank 28*b* of the swing arm 28. In the illustrated example, the respective spring member 22*a*, 22*b* is mounted to a telescopic link 30. A first part 31 of the respective telescopic link 30 is articulately connected to the associated shank 28*a*, 28*b* of the swing arm 28 through the seventh joint J7 and a second part 32 of the respective telescopic link 30 is articulately mounted to the base 2 through an eight joint J8, which forms an eight pivot axis P8 that extends in parallel with the above-mentioned pivot axes P1-P7. The two parts 31, 32 of the respective telescopic link 30 are moveable towards each other against the action of the associated spring member 22*a*, 22*b*. Each spring member 22*a*, 22*b* has the form of a compression spring, which at one end bears against a shoulder on the first part 31 of the associated telescopic link 30 and at the other end bears against an opposite shoulder on the second part 32 of the associated telescopic link. The spring members 22*a*, 22*b* also act on the lever 12 of the wire retaining member 10 via the links 29, 24 connected to the blocking member 23.

In the illustrated example, a guide roller 33 is rotatably mounted at the leading edge of the maneuvering member 21 in order to reduce the friction between the wire 4 and the maneuvering member 21 when the wire comes into contact with the maneuvering member. The maneuvering member 21 bears against the structural part 111 via the guide roller 33 when the blocking mechanism 20 is in the blocking position. When the wire 4 is inclined into contact with the maneuvering member 21, it will first come into contact with the guide roller 33 and move the guide roller and thereby the maneuvering member 21 outwards away from the structural part 111. As an alternative to a guide roller 33, the maneuvering member 21 may be provided with a wear plate or the similar at its leading edge.

The retainer unit 1 is to be mounted to the structural part 111 in such a position that the wire 4, when being tightened, first comes into contact with the wire contacting part 11 of the wire retaining member 10 without exerting any influence on the maneuvering member 21 of the blocking mechanism 20, as illustrated in FIGS. 1*a*-1*c*. At this stage, the wire retaining member 10 is in the advanced wire retaining position with the wire contacting part 11 bearing against the structural part 111, whereas the blocking mechanism 20 is in the blocking position and thereby prevents the wire retaining member 10 from being pivoted to the retracted wire releasing position under the effect of the press force exerted by the wire 4 against the wire contacting part 11. When the blocking mechanism 20 is in this blocking position, the maneuvering member 21 is located in an advanced position close to the structural part 111.

Figure 2B:
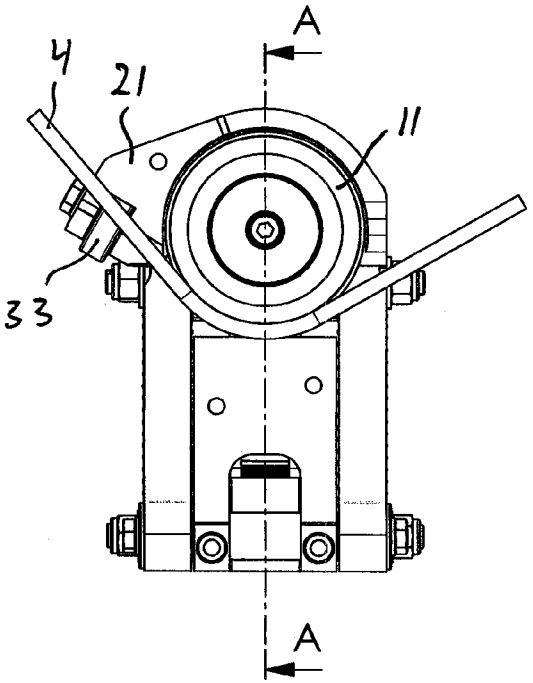
FIG. 2*b* is a front view corresponding to FIG. 2*a*.
Figure 2A:
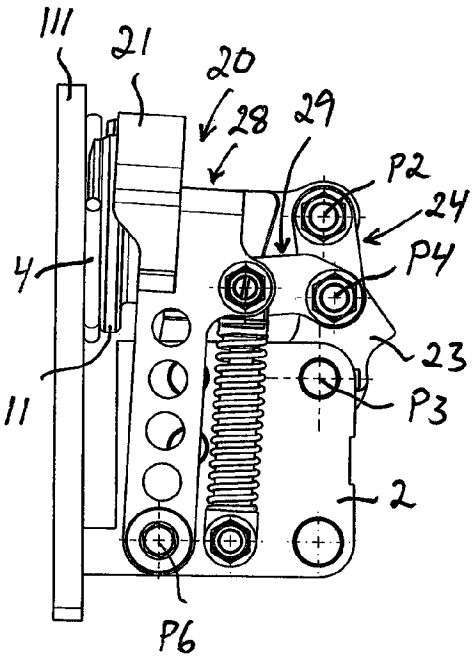
FIG. 2*a* is a lateral view of the retainer unit of FIG. 1*a*, as seen with the blocking mechanism in the non-blocking position and the wire retaining member in the wire retaining position.

When the wire 4 is released from another retainer unit located between the retainer unit 1 and the leading end of the wire, the angle of incidence of the wire towards the retainer unit 1 is changed and the wire will reach such an inclination in relation to the wire contacting part 11 of the wire retaining member that it comes into contact with the guide roller 33 of the maneuvering member 21 and thereby forces the maneuvering member 21 to move outwards away from the structural part 111 to a retracted position, as illustrated in FIGS. 2*a*-2*c*.

This movement of the maneuvering member 21 is transmitted via the swing arm 28 and the link 29 to the blocking member 23 and causes a rotation of the blocking member 23 about the third pivot axis P3 from the rotational position illustrated in FIG. 1*c* to the rotational position illustrated in FIG. 2*c*. The blocking mechanism 20 is hereby moved to the non-blocking position and thereby makes it possible for the wire retaining member 10 to be pivoted to the retracted wire releasing position under the effect of the press force exerted by the wire 4 against the wire contacting part 11.

On further tightening of the wire 4, the wire will exert such a press force of the wire contacting part 11 of the wire retaining member that the wire contacting part 11 is pivoted together with the lever 12 about the first pivot axis P1 outwards away from the structural part 111 and thereby leaves room for the wire 4 to pass between the wire contacting part 11 and the structural part 111 out of engagement with the retainer unit 1, as illustrated in FIGS. 3*a*-3*c*. When the wire 4 has been released from the retainer unit 1, the wire retaining member 10 is automatically returned to the wire retaining position and the blocking mechanism 20 is automatically returned to the blocking position, under the action of the spring members 22*a*, 22*b*, 41. The retainer unit 1 is then ready for a new wire binding sequence.

A part of a wire binding machine 100 comprising several retainer units 1*a*-1*e* of the above-mentioned type is illustrated in FIGS. 4*a*-4*g*. This wire binding machine comprises:

- a wire guide track arrangement 110 for guiding a wire 4, preferably a metal wire, in at least one loop around a space 101 configured for receiving one or more objects 3 to be bound;
- a feeding device (not shown) for feeding the wire into said wire guide arrangement 110 and along the wire guide arrangement in at least one loop around said space 101 and subsequently retracting the wire to draw it tightly around one or more objects 3 received in said space 101; and
- a gripping member (not shown) for gripping and locking the leading end of the wire 4 after the feeding thereof in at least one loop around said space 101.

The gripping member is displaceably mounted in a twisting head 104, which is rotatably mounted to the frame 105 of the wire binding machine 100.

Figure 4A:
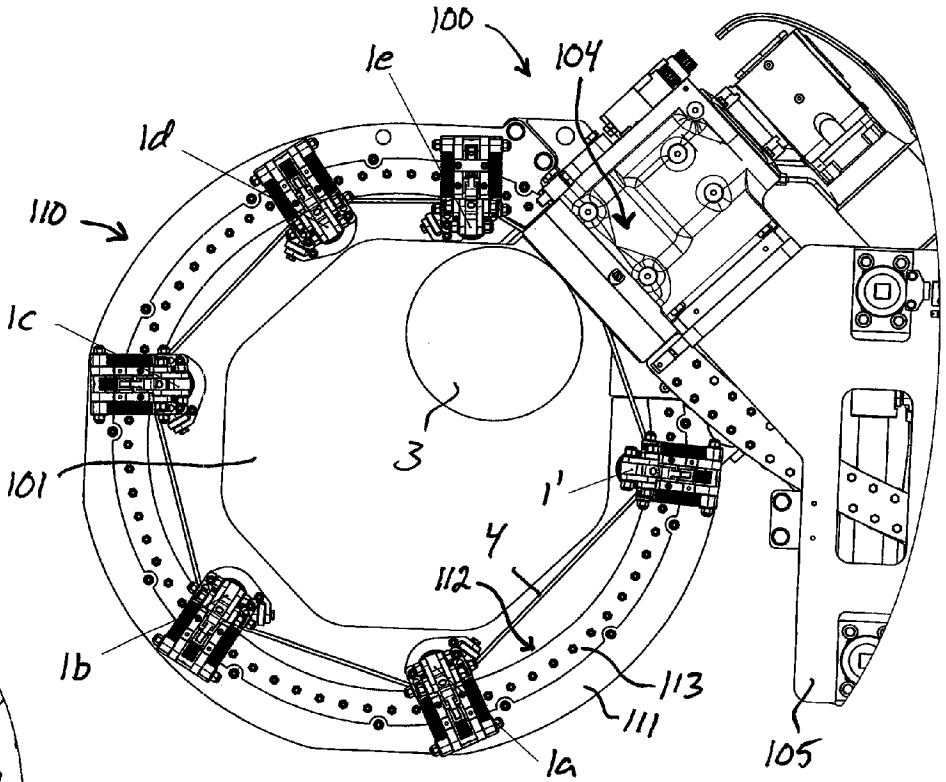
Figure 5A:
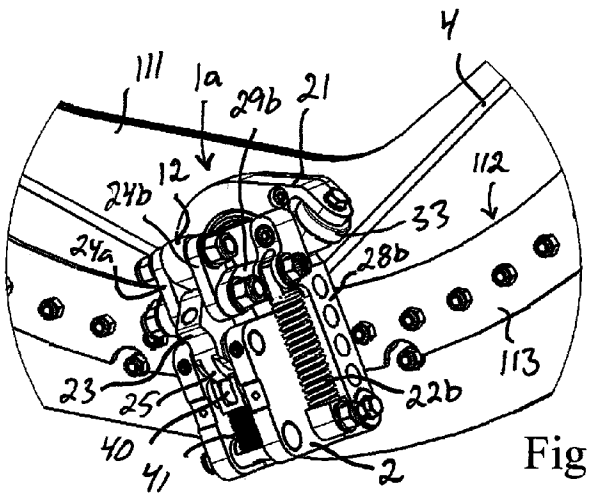
FIGS. 5*a*-5*g* are perspective views of different retainer units included in the wire binding machine of FIG. 4*a*-4*g*, as seen at different stages during the tightening of a wire around an object.

In the illustrated example, the wire guide track arrangement 110 comprises five retainer units 1*a*-1*e* of the above-mentioned type distributed around said space 101 in such a manner that the wire 4 will come to bear against the wire contacting part 11 of the wire retaining member 10 of the respective retainer unit when the wire is retracted by the feeding device, as illustrated in FIG. 4*a*. These retainer units 1*a*-1*e* are arranged to release the wire 4 consecutively one by one during the tightening of the wire around one or more objects 3 received in said space 101, starting with the retainer unit 1*a* located closest to the gripping member as seen in the direction backwards along the wire from the gripping member. A retainer unit 1' lacking a blocking mechanism 20 of the type described above is located between the gripping member and the retainer unit 1*a*. This retainer unit 1' is to release the wire before the other retainer units 1*a*-1*e* and a blocking mechanism is therefore not necessary on this retainer unit 1'. The last-mentioned retainer unit 1' may be provided with a wire retaining member of a type similar to the wire retaining member 10 included in the other retainer units 1*a*-1*e*.

In the illustrated embodiment, the retainer units 1*a*-1*e*, 1' are mounted to a structural part 111 in the form of a guide plate, which extends in a curve around said space 101. A curved guide track 112 is formed between this guide plate 111 and an adjacent curved guide plate 113. Guide rollers (not shown) are rotatably mounted between the guide plates 111, 113 and distributed along the guide track 112.

The feeding device is with advantage provided with an electric motor (not shown) for feeding and pulling the wire. However, the feeding device may alternatively be provided with a hydraulic motor for feeding and pulling the wire.

An operating sequence for securing a loop of metal wire around an object 3 with the aid of the above-described wire binding machine 100 will now be described with reference to FIGS. 4*a*-4*g* and FIGS. 5*a*-5*g*.

In a first step, the motor of the feeding device is operated in a first direction in order to feed a metal wire 4 forwards from a wire coil, through a first channel in the twisting head 104 and into the guide track 112. The wire 4 is fed forwards in the guide track 112 in a loop around the space 101, while rolling on the guide rollers between the guide plates 111, 113. The leading end of the wire 4 will then leave the guide track 112 and pass into a second channel in the twisting head 104, whereupon the leading end of the wire actuates a stop member and the motor of the feeding device is stopped and the gripping member is displaced to grip the leading end of the wire 4 to thereby lock the leading end of the wire to the twisting head 104. An object 3 or a bundle of objects is feed into the space 101, for instance by means of a conveyor (not shown).

Thereafter, the motor of the feeding device is reversed in order to pull the metal wire 4 backwards and thereby tighten the wire around the object 3. A tension is hereby developed in the metal wire loop. During a first phase of this tightening, the wire 4 is pulled out of the guide track 112 so as to come to bear against the wire contacting part 11 of the wire retaining member 10 of the respective retainer unit 1*a*-1*e*, 1', as illustrated in FIG. 4*a*. At this stage, the wire retaining members 10 of all retainer units 1*a*-1*e*, 1' are in the wire retaining position and the blocking mechanisms 20 of the retainer units 1*a*-1*e* located after the first retainer unit 1' are in the blocking position and thereby prevents the wire retaining members 10 of these retainer units 1*a*-1*e* from being pivoted to the retracted wire releasing position under the effect of the press force exerted by the wire 4 against the wire contacting parts 11. At this stage, the wire 4 has such an inclination in relation to the wire contacting parts 11 of the last-mentioned retainer units 1*a*-1*g* that the wire is kept out of contact with the maneuvering members 21 of these retainer units.

Figure 4B:
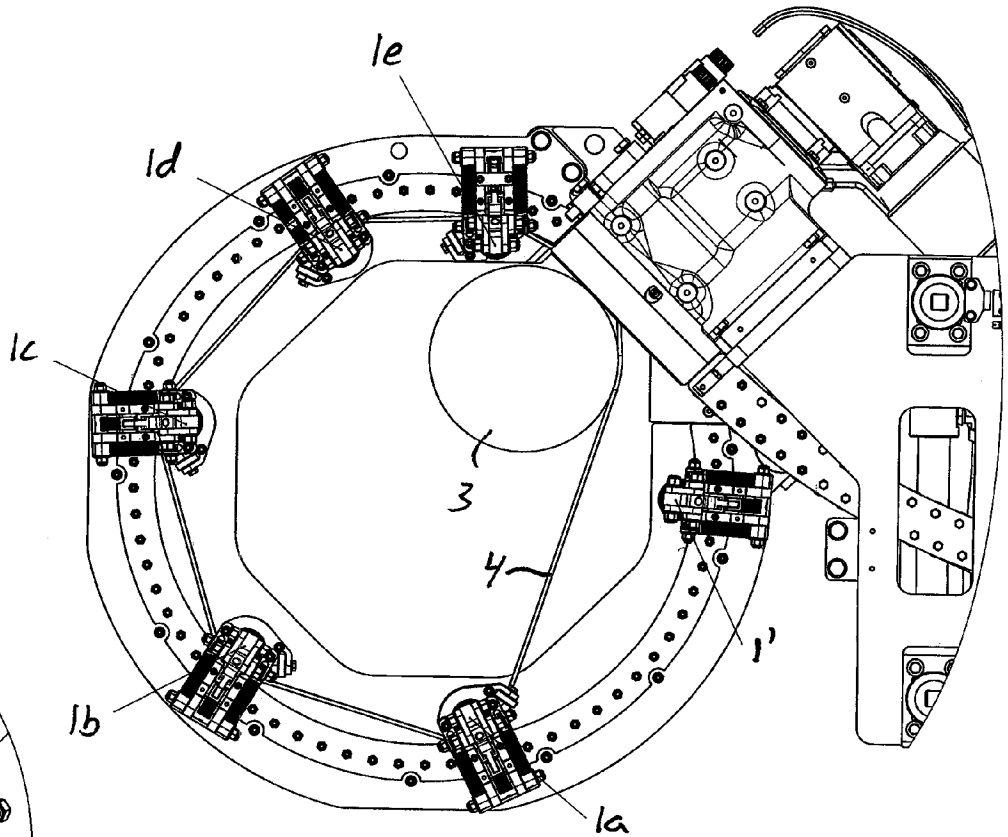
Figure 5B:
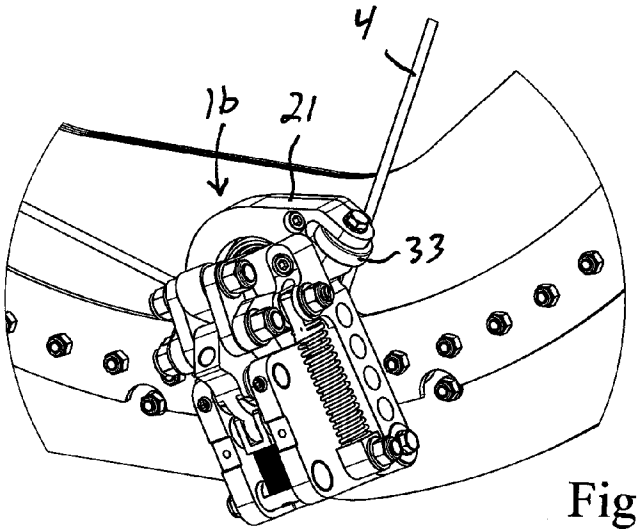
Figure 4C:
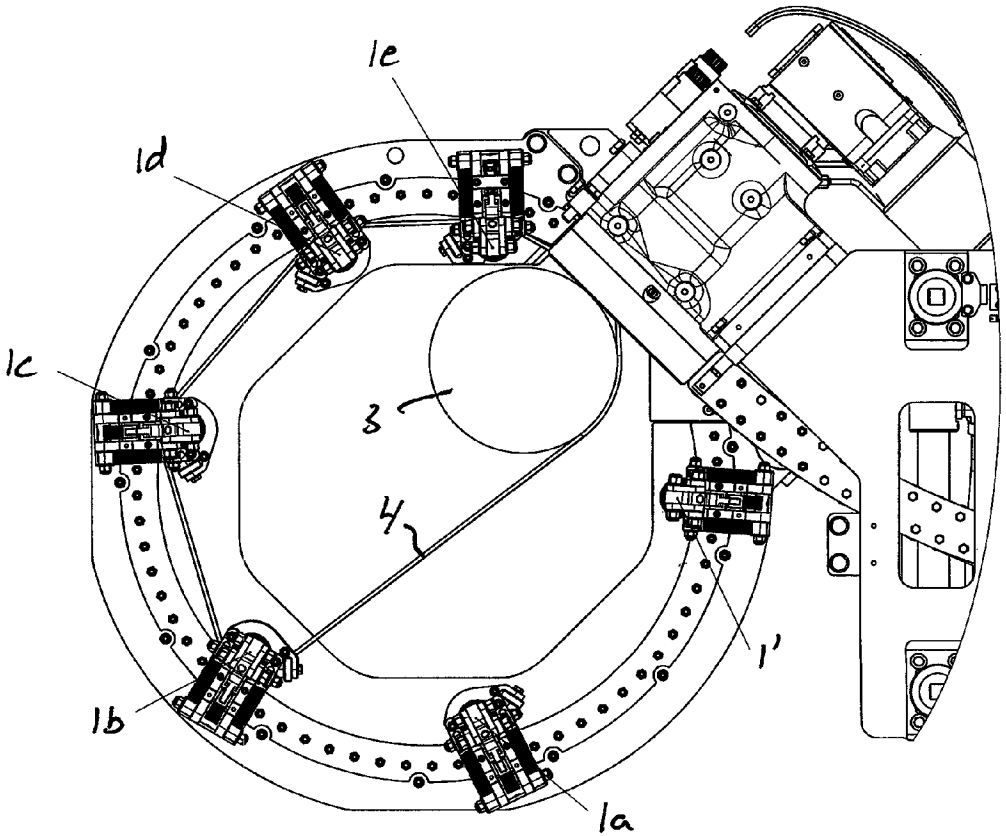
Figure 5C:
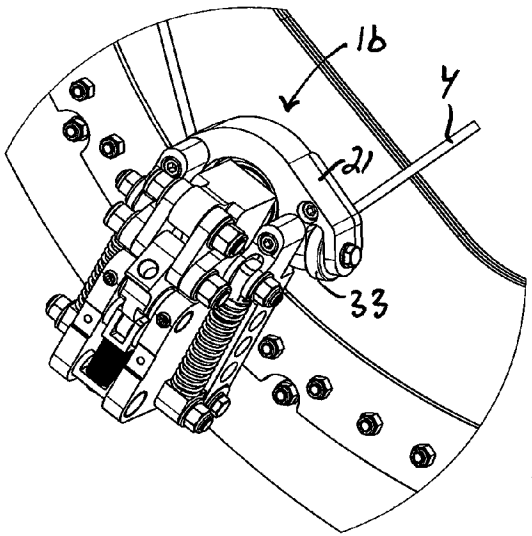
Figure 4D:
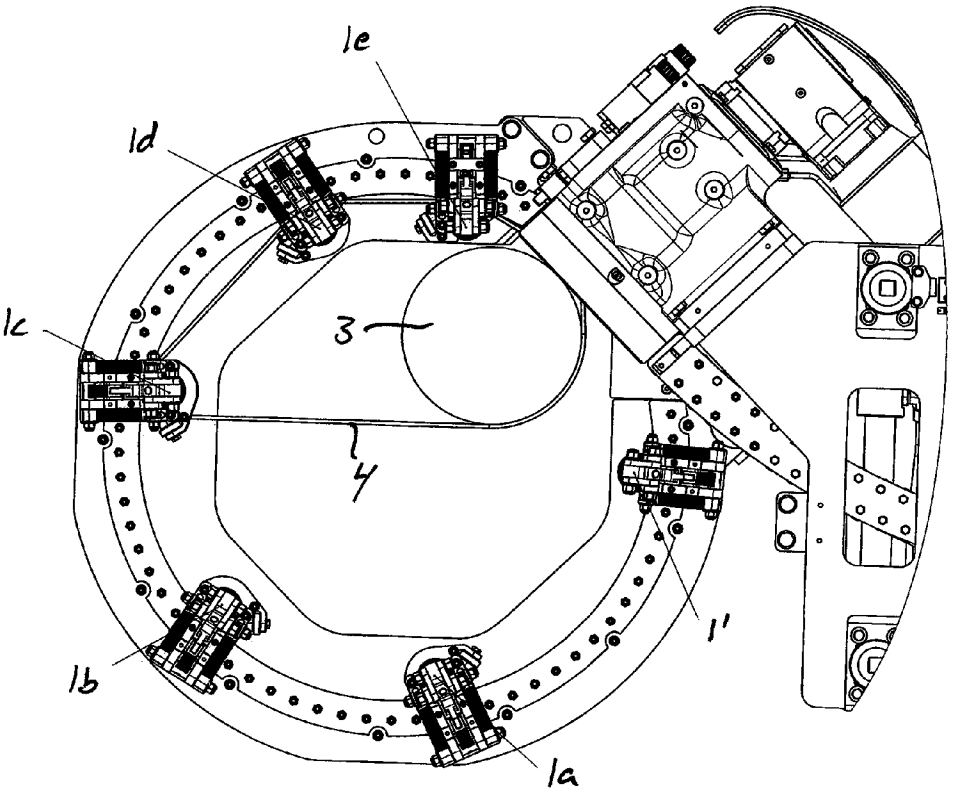
Figure 5D:
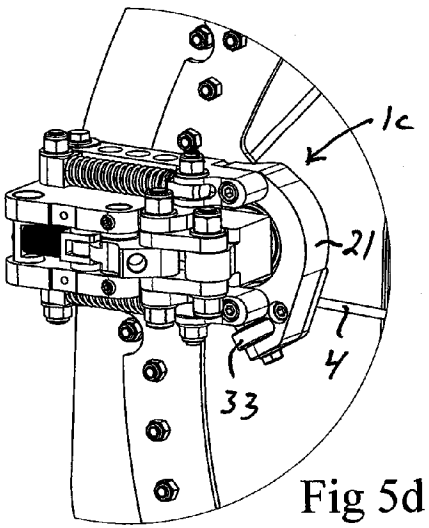
Figure 4E:
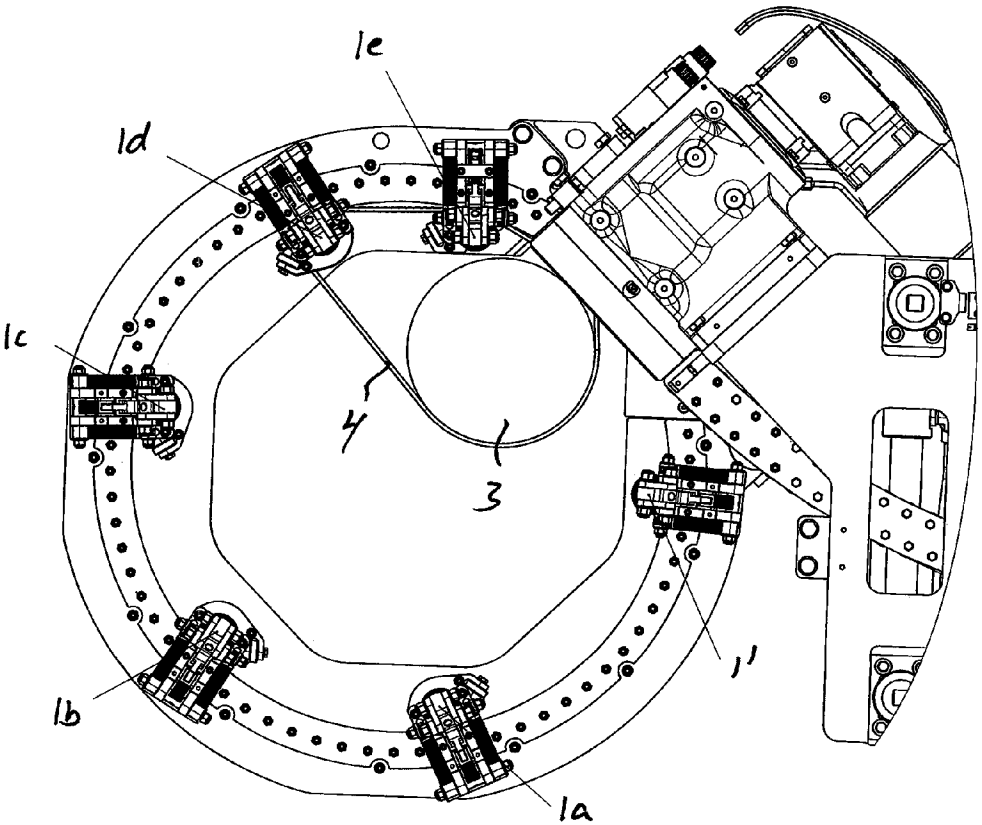
Figure 5E:
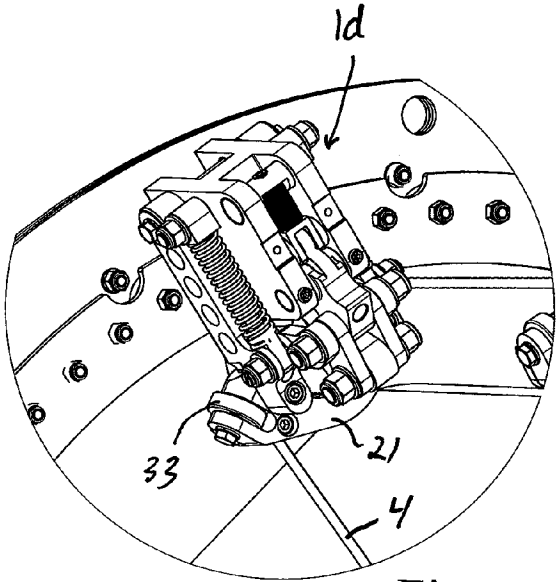
Figure 4F:
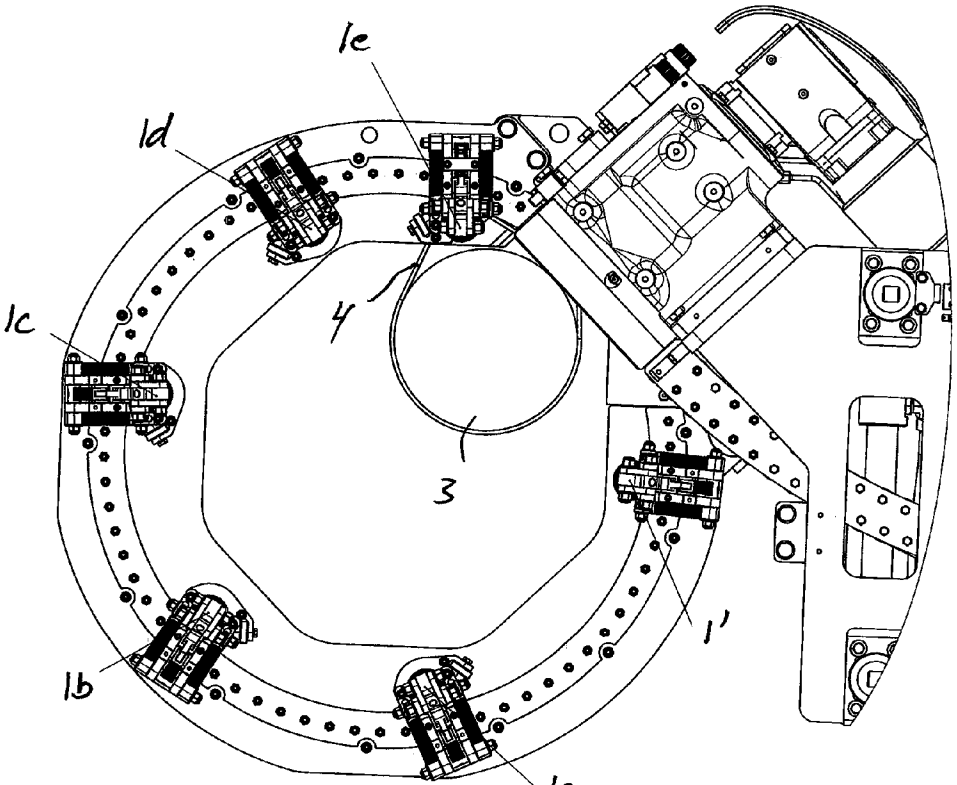
Figure 5F:
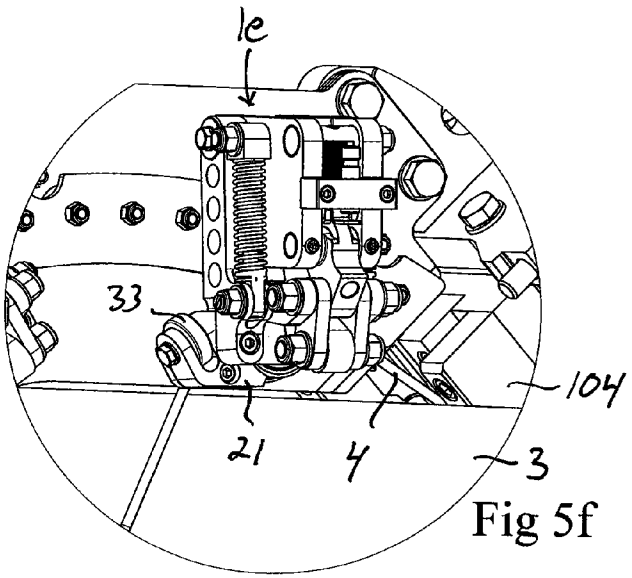
Figure 4G:
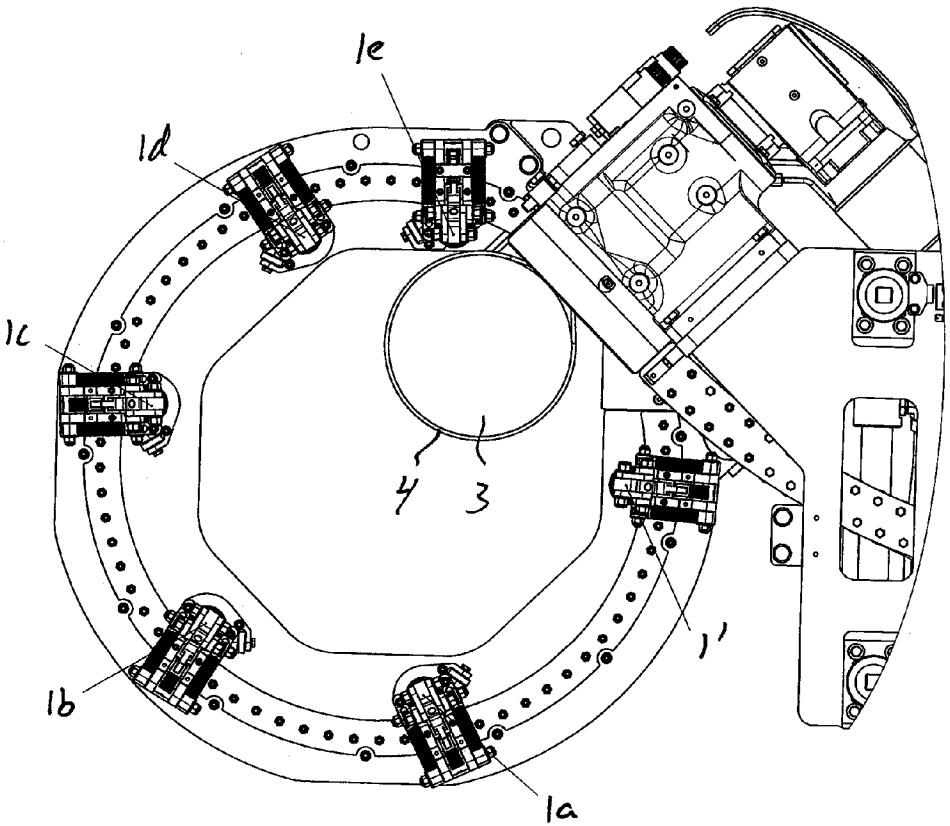
Figure 5G:
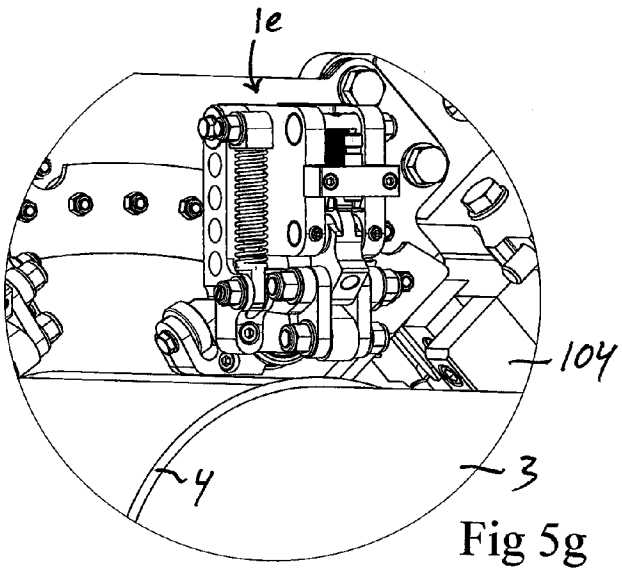

When a sufficient tension has been developed in the wire 4, the wire retaining member 10 of the first retainer unit 1' is moved to the wire releasing position under the effect of the press force exerted by the wire against the wire contacting part 11 of this retainer unit. On being released from this retainer unit 1', the wire 4 is pulled inwards into contact with a first part of the outer surface of the object 3, as illustrated in FIG. 4*b*. At the same time, the wire 4 assumes such an inclination in relation to the next retainer unit 1*a* that the wire comes into contact with the guide roller 33 of the maneuvering member 21 of this retainer unit and thereby effects a movement of its blocking mechanism 20 to the non-blocking position, as illustrated in FIGS. 4*b* and 5*b*. When a sufficient tension has been developed in the wire 4, the wire retaining member 10 of this retainer unit 1*a* is moved to the wire releasing position under the effect of the press force exerted by the wire against the wire contacting part 11 of this retainer unit. On being released from this retainer unit 1*a*, the wire 4 is pulled inwards into contact with a second part of the outer surface of the object 3, as illustrated in FIG. 4*c*. At the same time, the wire 4 assumes such an inclination in relation to the next retainer unit 1*b* that the wire comes into contact with the guide roller 33 of the maneuvering member 21 of this retainer unit and thereby effects a movement of its blocking mechanism 20 to the non-blocking position, as illustrated in FIGS. 4*c* and 5*c*. The procedure described above is then repeated step by step during a continuous tightening of the wire 4, in such a manner that the wire is released from the last-mentioned retainer unit 1*b*, thereafter from the next retainer unit 1*c*, then from the next retainer unit 1*d* and finally from the last retainer unit 1*e*, as illustrated in FIGS. 4*d*-4*g* and FIGS. 5*d*-5*g*.

When the wire 4 has been released from the last retainer unit 1*e* and drawn tightly all around the object 3, the motor of the feeding device is stopped and the twisting head 104 is rotated in order to bind the overlapping wire portions received in the channels of the twisting head together by twisting and thereby secure the wire loop to the object 3, whereupon said wire portions are released from the twisting head 104. When the twisting head 104 starts to rotate, the part of the wire extending from the twisting head 104 towards the feeding device is cut off by means of a cutting member provided in the twisting head.

The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. A retainer unit for use in a wire guide track arrangement of a wire binding machine in order to retain and subsequently release a wire during the tightening thereof around one or more objects, the retainer unit (1) comprising:

a base (2) to be fixedly mounted to a structural part of a wire guide track arrangement of a wire binding machine; and a wire retaining member (10), which is pivotally mounted to the base (2) and comprises a wire contacting part (11) intended to come into contact with a wire during the tightening thereof around one or more objects, the wire retaining member (10) being pivotable, under the action of a press force exerted by a wire bearing against the wire contacting part (11), from an advanced wire retaining position, in which the wire retaining member (10) keeps the wire retained to the retainer unit (1), to a retracted wire releasing position, in which the wire is released from the retainer unit (1), wherein the retainer unit (1) comprises a blocking mechanism (20), which is moveable from a blocking position, in which the blocking mechanism (20) prevents the wire retaining member (10) from being pivoted from the wire retaining position to the wire releasing position, to a non-blocking position, in which the blocking mechanism (20) allows the wire retaining member (10) to be pivoted from the wire retaining position to the wire releasing position; and the blocking mechanism (20) is arranged to move from the blocking position to the non-blocking position under the effect of said wire when the wire, during the tightening thereof around one or more objects and on reaching a given inclination towards the wire contacting part (11) of the wire retaining member (10), comes into contact with a maneuvering member (21) included in the blocking mechanism (20) and moves this maneuvering member (21) from an advanced position to a retracted position.

2. The retainer unit according to claim 1, wherein the blocking mechanism (20) is moveable from the blocking position to the non-blocking position against the action of the spring force from one or more spring members (22*a*, 22*b*).

3. The retainer unit according to claim 1, wherein the wire retaining member (10) comprises a lever (12), this lever being pivotally mounted to the base (2) through a first joint (J1), which forms a first pivot axis (P1), and articulately connected to the blocking mechanism (20) through a second joint (J2), which forms a second pivot axis (P2) that extends in parallel with said first pivot axes (P1); and the wire contacting part (11) is carried by said lever (12).

4. The retainer unit according to claim 3, wherein the blocking mechanism (20) comprises a blocking member (23), which is pivotally mounted to the base (2) through a third joint (J3), which forms a third pivot axis (P3) that extends in parallel with said first pivot axis (P1);

the blocking mechanism (20) comprises a link (24), this link having a first end articulately connected to the lever (12) through said second joint (J2) and a second end articulately connected to the blocking member (23) through a fourth joint (J4), which forms a fourth pivot axis (P4) that extends in parallel with said first pivot axis (P1);

the blocking member (23), when the blocking mechanism is in the blocking position, is located in such a rotational position about said third pivot axis (P3) that said fourth pivot axis (P4) lies in the plane in which said second and third pivot axes (P2, P3) extend, the lever (12) thereby being prevented from pivoting in relation to the base (2) about said first pivot axis (P1); and the blocking member (23), when the blocking mechanism is in the non-blocking position, is located in such a rotational position about said third pivot axis (P3) that said fourth pivot axis (P4) is offset from the plane in which said second and third pivot axes (P2, P3) extend, the lever (12) thereby being allowed to pivot in relation to the base (2) about said first pivot axis (P1).

5. The retainer unit according to claim 2, wherein the blocking mechanism (20) comprises a swing arm (28), here denominated first swing arm, which carries the maneuvering member (21) and which is pivotally mounted to the base (2) through a joint (J6), which forms a pivot axis (P6) that extends in parallel with said first pivot axis (P1); and said one or more spring members (22*a*, 22*b*) are arranged to act on this first swing arm (28).

6. The retainer unit according to claim 5, wherein said first swing arm (28) is connected to the blocking member (23) and configured to effect a rotation of the blocking member about said third pivot axis (P3) when the blocking mechanism (20) is moved from the blocking position to the non-blocking position.

7. The retainer unit according to claim 6, wherein said first swing arm (28) is connected to the blocking member (23) through a link (29), which at one end is articulately connected to the blocking member (23) through said fourth joint (J4) and at the other end is articulately connected to the first swing arm (28).

8. The retainer unit according to claim 4, wherein the retainer unit (1) comprises a rolling member (40), which is biased by one or more spring members (41) to bear against a guide surface (25) on the periphery of the blocking member (23) and which is arranged to roll along this guide surface (25) when the blocking member (23) is pivoted about said third pivot axis (P3).

9. The retainer unit according to claim 8, wherein the retainer unit (1) comprises a swing arm (42), here denominated second swing arm, which is pivotally mounted to the base (2) through a fifth joint (J5), which forms a fifth pivot axis (P5) that extends in parallel with said first pivot axis (P1); and the rolling member (40) is rotatably mounted to this second swing arm (42) at a distance from said fifth joint (J5).

10. The retainer unit according to claim 8, wherein a recess (26) is provided in said guide surface (25) on the blocking member (23), this recess (26) having a concave shape as seen in a plane perpendicular to said third pivot axis (P3);

that the rolling member (40) is received in and arranged to roll within said recess (26) when the blocking member (23) is pivoted about said third pivot axis (P3) during a movement of the blocking mechanism (20) from the blocking position to the non-blocking position; and that the rolling member (40) is arranged to roll out of said recess (26) and up onto an adjacent part (27) of said guide surface (25) when the blocking member (23) is pivoted about said third pivot axis (P3) during a movement of the wire retaining member (10) from the wire retaining position to the wire releasing position.

11. The retainer unit according to claim 10, wherein said part (27) of the guide surface (25) has a circular cylindrical shape with a centre axis coinciding with said third pivot axis (P3).

12. The retainer unit according to claim 1, wherein the wire retaining member (10) is pivotable from said advanced wire retaining position to said retracted wire releasing position against the action of one or more spring members (22*a*, 22*b*, 41).

13. The retainer unit according to claim 1, wherein the maneuvering member (21) comprises a guide roller (33), which is rotatably mounted at the leading edge of the maneuvering member (21) to reduce the friction between the wire and the maneuvering member (21) when the wire comes into contact with the maneuvering member.

14. A wire binding machine comprising:

a wire guide track arrangement (110) for guiding a wire in at least one loop around a space (101) configured for receiving one or more objects to be bound;

a feeding device for feeding the wire into said wire guide arrangement (110) and along the wire guide arrangement in at least one loop around said space (101) and subsequently retracting the wire to draw it tightly around one or more objects received in said space (101); and a gripping member for gripping and locking the leading end of the wire after the feeding thereof in at least one loop around said space (101); wherein the wire guide arrangement (110) is provided with several retainer units (1*a*-1*g*), each of the retainer units comprising: a base (2) to be fixedly mounted to a structural part of the wire guide track arrangement, and a wire retaining member (10), which is pivotally mounted to the base (2) and comprises a wire contacting part (11) intended to come into contact with a wire during the tightening thereof around one or more objects, the wire retaining member (10) being pivotable, under the action of a press force exerted by a wire bearing against the wire contacting part (11), from an advanced wire retaining position, in which the wire retaining member (10) keeps the wire retained to the retainer unit (1), to a retracted wire releasing position, in which the wire is released from the retainer unit (1), wherein the retainer unit (1) further comprises a blocking mechanism (20), which is moveable from a blocking position, in which the blocking mechanism (20) prevents the wire retaining member (10) from being pivoted from the wire retaining position to the wire releasing position, to a non-blocking position, in which the blocking mechanism (20) allows the wire retaining member (10) to be pivoted from the wire retaining position to the wire releasing position; and the blocking mechanism (20) is arranged to move from the blocking position to the non-blocking position under the effect of said wire when the wire, during the tightening thereof around one or more objects and on reaching a given inclination towards the wire contacting part (11) of the wire retaining member (10), comes into contact with a maneuvering member (21) included in the blocking mechanism (20) and moves the maneuvering member (21) from an advanced position to a retracted position, the retainer units (1*a*-1*g*) are distributed around said space (101) in such a manner that the wire will come to bear against the wire contacting part (11) of the wire retaining member (10) of the respective retainer unit (1*a*-1*g*) when the wire is retracted by said feeding device, and the retainer units (1*a*-1*g*) are arranged to release the wire consecutively one by one during the tightening of the wire around one or more objects received in said space (101), starting with the retainer unit (1*a*) located closest to the gripping member as seen in a direction backwards along the wire from the gripping member.

15. The wire binding machine according to claim 14, wherein the feeding device comprises an electric motor for feeding and retracting the wire.

16. The retainer unit according to claim 2, wherein the wire retaining member (10) comprises a lever (12), this lever being pivotally mounted to the base (2) through a first joint (J1), which forms a first pivot axis (P1), and articulately connected to the blocking mechanism (20) through a second joint (J2), which forms a second pivot axis (P2) that extends in parallel with said first pivot axes (P1); and the wire contacting part (11) is carried by said lever (12).

17. The retainer unit according to claim 16, wherein the blocking mechanism (20) comprises a blocking member (23), which is pivotally mounted to the base (2) through a third joint (J3), which forms a third pivot axis (P3) that extends in parallel with said first pivot axis (P1);

the blocking mechanism (20) comprises a link (24), this link having a first end articulately connected to the lever (12) through said second joint (J2) and a second end articulately connected to the blocking member (23) through a fourth joint (J4), which forms a fourth pivot axis (P4) that extends in parallel with said first pivot axis (P1);

the blocking member (23), when the blocking mechanism is in the blocking position, is located in such a rotational position about said third pivot axis (P3) that said fourth pivot axis (P4) lies in the plane in which said second and third pivot axes (P2, P3) extend, the lever (12) thereby being prevented from pivoting in relation to the base (2) about said first pivot axis (P1); and the blocking member (23), when the blocking mechanism is in the non-blocking position, is located in such a rotational position about said third pivot axis (P3) that said fourth pivot axis (P4) is offset from the plane in which said second and third pivot axes (P2, P3) extend, the lever (12) thereby being allowed to pivot in relation to the base (2) about said first pivot axis (P1).

18. The retainer unit according to claim 17, wherein the blocking mechanism (20) comprises a swing arm (28), here denominated first swing arm, which carries the maneuvering member (21) and which is pivotally mounted to the base (2) through a joint (J6), which forms a pivot axis (P6) that extends in parallel with said first pivot axis (P1); and said one or more spring members (22*a*, 22*b*) are arranged to act on this first swing arm (28).

19. The retainer unit according to claim 16, wherein the blocking mechanism (20) comprises a swing arm (28), here denominated first swing arm, which carries the maneuvering member (21) and which is pivotally mounted to the base (2) through a joint (J6), which forms a pivot axis (P6) that extends in parallel with said first pivot axis (P1); and said one or more spring members (22*a*, 22*b*) are arranged to act on this first swing arm (28).

20. The retainer unit according to claim 4, wherein the blocking mechanism (20) comprises a swing arm (28), here denominated first swing arm, which carries the maneuvering member (21) and which is pivotally mounted to the base (2) through a joint (J6), which forms a pivot axis (P6) that extends in parallel with said first pivot axis (P1); and said one or more spring members (22*a*, 22*b*) are arranged to act on this first swing arm (28).

* * * * *